US005815176A

United States Patent [19]

Rotering

[11] Patent Number: 5,815,176

[45] Date of Patent: Sep. 29, 1998

[54] MULTI-FINNED WIPING SYSTEM FOR INKJET PRINTHEADS

[75] Inventor: Catherine A. Rotering, Vancouver, Wash.

[73] Assignee: Hewlett-Packard Company, Palo Alto, Calif.

[21] Appl. No.: 593,960

[22] Filed: Jan. 30, 1996

[51] Int. Cl.[6] ..... B41J 2/165

[52] U.S. Cl. ..... 347/33; 347/29; 347/24

[58] Field of Search ..... 347/29, 30, 32, 347/33, 22, 24

[56] References Cited

U.S. PATENT DOCUMENTS

| | | | |
|---|---|---|---|
| 4,306,245 | 12/1981 | Kasugayama et al. | 347/33 |
| 4,935,753 | 6/1990 | Lehmann et al. | 347/33 |
| 5,103,244 | 4/1992 | Gast et al. | 347/33 |
| 5,115,250 | 5/1992 | Harmon et al. | 347/33 |
| 5,614,930 | 3/1997 | Osborne et al. | 347/33 |

FOREIGN PATENT DOCUMENTS

| | | | |
|---|---|---|---|
| 59-209876 | 11/1984 | Japan | B41J 3/04 |

*Primary Examiner*—Peter S. Wong
*Assistant Examiner*—Bao Q. Vu
*Attorney, Agent, or Firm*—Flory L. Martin

[57] ABSTRACT

A multi-finned wiping system is provided for wiping an inkjet printhead that accumulates ink residue when used in an inkjet printing mechanism. A service station supports a wiper that contacts and wipes ink residue from the printhead. The service station also supports a cleaner that contacts and cleans the wiper. Either the wiper or the cleaner maybe constructed is of a resilient material comprising plural fins arranged to define an interstice between adjacent fins to capture the ink residue in the interstice. Interaction of the wiper and cleaner during the cleaning process pumps ink residue from the interstice to ready the fins for the next cleaning cycle. An inkjet printing mechanism having such a finned wiping system is also provided, along with a method of wiping accumulated ink residue from an inkjet printhead installed in an inkjet printing mechanism.

27 Claims, 4 Drawing Sheets

MULTI-FINNED WIPING SYSTEM FOR INKJET PRINTHEADS

FIELD OF THE INVENTION

The present invention relates generally to inkjet printing mechanisms, and more particularly to multi-finned wiping system for cleaning an inkjet printhead, including a wiper to wipe the printhead and cleaner for removing ink residue from the wiper, with either the wiper or the cleaner being of a multi-finned construction.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is supported by the printer chassis so the printhead can be moved over the station for maintenance. For storage, or during non-printing periods, the service stations usually include a capping system which substantially seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead. The wiping action is usually achieved by either moving the printhead across the wiper, or moving the wiper across the printhead.

To improve the clarity and contrast of the printed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. With the earlier dye-based inks, wiping the printhead with an elastomeric wiper was sufficient. However, with the advent of the pigment-based inks, a secondary operation of cleaning the wiper has become necessary to remove sticky pigment ink residue from the wiper. In the early printers using these pigment based inks, this secondary wiper cleaning operation was accomplished using a rigid plastic scrapper. Through relative motion of either the scrapper, the wiper blade, or both, the wiper was scrapped across the plastic cleaner to remove ink from the surfaces of the wiper blade. Some plastic scrappers even required intricate ink wicking channels to draw the liquid portions of the ink away from the main scrapper surface, and preferably, into some type of blotter or other absorbent material.

Unfortunately, the pigment-based ink residue would accumulate on the wiper surface in the form of a paste, which the earlier plastic scrapper was not totally effective in removing. Instead, when encountering this paste-like consistency of ink residue, the plastic scrapper tended to smear the ink on the surface of the wiper, rather than removing it. Another disadvantage of the plastic scrapper is believed to be wear on the wiper, with the scrapper actually removing fine microlayers or otherwise pitting and damaging the wiper surface. Another drawback of the plastic scrapper is the tendency of the wiper blade when moving past the scrapper to flick ink off of the cleaning surface. This ink splatter or flicking action propelled the ink residue to other areas and components inside the printer service station, dirtying any surfaces where it landed. Additionally, the plastic scrapper system typically provided only two cleaning surfaces for the wiper, assuming that the wiper moved reciprocally back and forth across the scrapper.

Thus, a need exists for an inkjet printhead wiping system capable of accommodating both fast drying dye-based and pigment-based inks, including a secondary wiper cleaner, which is insensitive to paste-like ink build-up on the wiper, which minimizes wiper wear and ink flicking from the wiper blade, and which provides an expanded cleaning surface for the wiper.

SUMMARY OF THE INVENTION

According to one aspect of the present invention, a finned wiping system is provided for wiping an inkjet printhead that accumulates ink residue when used in an inkjet printing mechanism that has a chassis. The finned wiping system includes a service station supported by the printing mechanism chassis. A wiper is supported by the service station to selectively contact and wipe the printhead to remove ink residue from the printhead. A cleaner is also supported by the service station to selectively contact and clean the wiper. Either the wiper or the cleaner maybe constructed is of a resilient material comprising plural fins arranged to define an interstice between adjacent fins to capture the ink residue in the interstice. Webster's Dictionary defines an "interstice" as a space that intervenes between things, such as an interval, and especially one between closely spaced things, here, between the adjacent fins. The adjective "interstitial" is defined by Webster's as "relating to or situated in the interstices."

In one illustrated embodiment, the wiper comprises the plural fins, with the plural fins defining a cleaning region across which the printhead traverses from one fin to the next adjacent fin through relative motion of the printhead and wiper. In another embodiment, the wiper comprises a blade of a resilient material, and the cleaner comprises the plural fins. Here, the cleaner plural fins define a cleaning region across which the wiper blade moves from one fin to the next adjacent fin to clean the wiper.

According to yet another aspect of the present invention, an inkjet printing mechanism may be provided with the finned wiping system described above.

According to another aspect of the present invention, a method is provided for wiping accumulated ink residue from an inkjet printhead in an inkjet printing mechanism. The method includes the steps of ejecting ink though the inkjet printhead and accumulating ink residue thereon, and wiping the accumulated ink residue from the printhead using a wiper. After the wiping step, in a cleaning step, the wiper is cleaned with a cleaner through relative motion of the wiper and cleaner, one of which comprises plural fins of a resilient material arranged to define an interstice between adjacent fins. Finally, in a capturing step, the ink residue is captured in the interstice.

An overall goal of the present invention is to provide an inkjet printing mechanism which prints sharp vivid images, particularly when using fast drying pigment or dye based inks.

Another goal of the present invention is to provide a robust multi-finned wiping system capable of reliably cleaning the nozzle face plate of an inkjet printhead, whether dispensing a dye-based ink or a pigment-based ink.

DETAILED DESCRIPTION OF A PREFERRED EMBODIMENT

Figure 1:
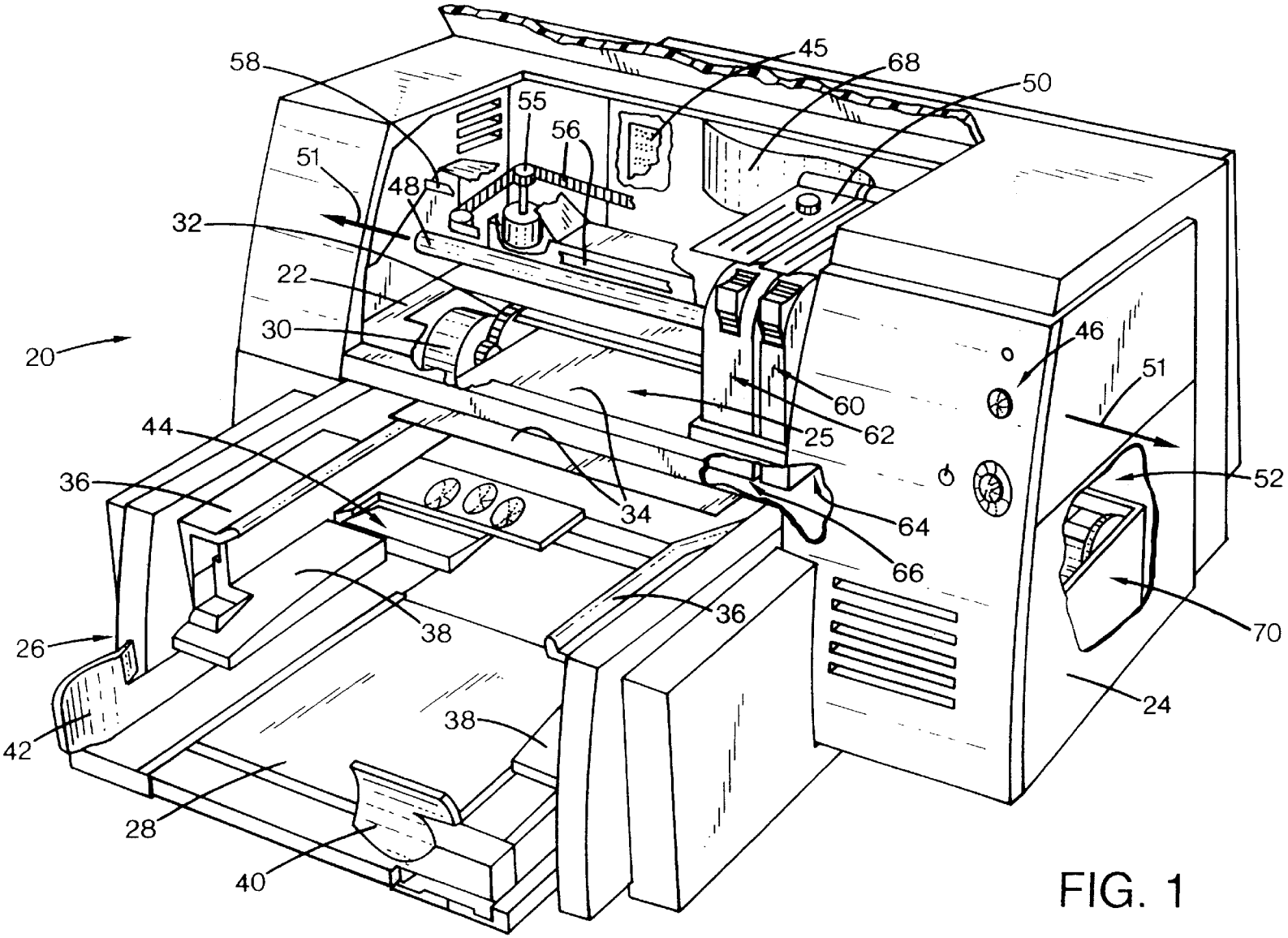
FIG. 1 is a perspective view of one form of an inkjet printing mechanism, here, an inkjet printer, including a printhead service station having one form of a finned wiping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few, as well as various combination devices, such as a combination facsimile/printer. For convenience the concepts of the present invention are illustrated in the environment of an inkjet printer 20.

While it is apparent that the printer components may vary from model to model, the typical inkjet printer 20 includes a frame or chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor and drive gear assembly 30, may be used to move the print media from tray 28 into the print zone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A-4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. One suitable type of carriage support system is shown in U.S. Pat. No. 5,366,305, assigned to Hewlett-Packard Company, the assignee of the present invention. A carriage drive gear and DC motor assembly 55 is coupled to drive an endless belt 56. The motor 55 operates in response to control signals received from the controller 45. The belt 56 may be secured in a conventional manner to the carriage 50 to incrementally advance the carriage along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art.

In the print zone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multi-conductor strip 68 from the controller 45 to the printhead carriage 50.

Figure 2:
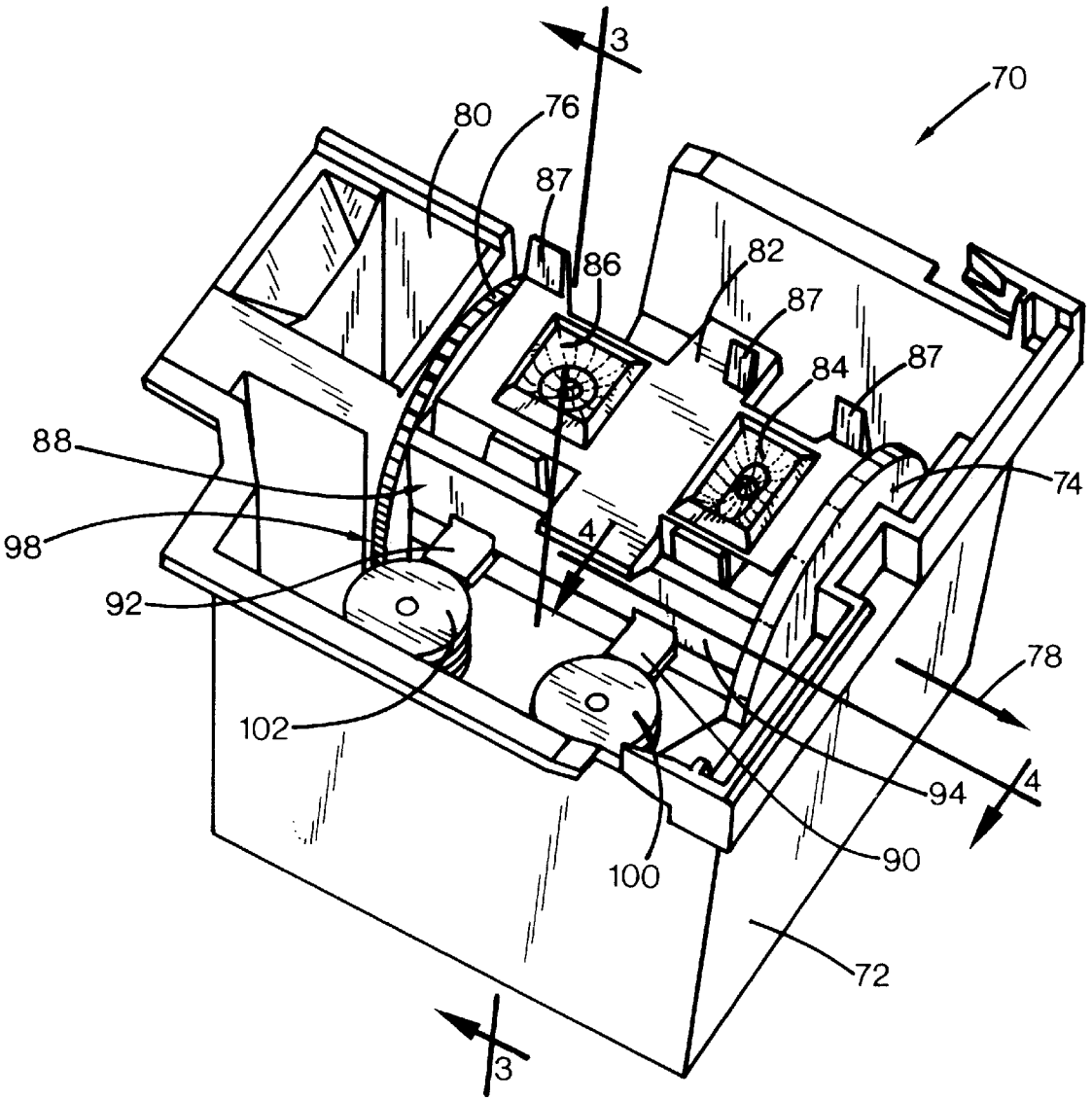
FIG. 2 is an enlarged perspective view of the service station of FIG. 1, showing wiping system of the present invention, including one form of a multi-finned wiper cleaner of the present invention.

FIG. 2 illustrates one embodiment of a printhead service station 70 that resides within the servicing region 52 of the printer enclosure 24. The service station 70 includes a service station frame 72 that supports a rotary service station tumbler 74. The service station tumbler 74 may be driven by a conventional gear mechanism (not shown) which engages a drive gear 76 of the tumbler. The tumbler 74 rotates about an axis 78, which is substantially parallel to the carriage scanning axis 51. The service station 70 also includes a spittoon 80 that receives ink purged or "spit" from the printheads 64, 66.

In addition to the spitting function, the service station 70 also accommodates other printhead servicing functions, such as capping the printheads 64, 66 during periods of inactivity, wiping the printheads to remove accumulated waste ink and debris, and/or priming the printheads. These various servicing mechanisms may be located along the periphery of tumbler 74. Illustrative of these different servicing devices, the service station 70 is shown with a sled 82 in position to support black and color printhead priming caps 84, 86, which are used to prime the respective black and color printheads 64, 66. For instance, the priming sled 82 may have one or more upright arms 88, which are rotated through operation of gear 76 into contact with the printhead carriage 50 to bring the priming caps 84, 86 into contact with the printheads 64, 66 for priming.

Multi-Finned Wiping System: Finned Cleaner Embodiment

The service station 70 also has a multi-finned wiping system 88, including a black ink wiper 90 and a color ink wiper 92, both of which are supported by a mounting platform portion or sled 94 of the tumbler body 74. When wiping the printheads 64, 66, the wiper blades 90, 92 wipe accumulated ink residue from the exterior surface of the nozzle face plate. As described above in the Background portion, this ink residue may include ink solids, paper fibers or other debris, and a liquid component of the ink. The black and color wipers 90, 92 may be of a substantially conventional construction, joined to the platform 94 in any conventional manner, such as by bonding with adhesives, sonic welding, or more preferably by onsert or insert molding techniques, where a portion of the wiper base extends through holes formed within platform 94. In the illustrated embodiment, the wipers 90, 92 are of a non-abrasive resilient material, such as an elastomer or plastic, a nitrile rubber or other rubber-like material, but preferably is of an ethylene polypropylene diene monomer (EPDM), or other comparable materials known in the art.

It is apparent to those skilled in the art that a variety of other mechanisms may be used to provide the printhead servicing functions of priming, wiping and capping, in place of the tumbler mechanism 74 illustrated in FIG. 2. Indeed, a variety of different servicing mechanisms are installed in commercially available inkjet printing mechanisms, many of which may be suitably substituted for the servicing mechanism of tumbler 74. For instance, suitable translating or floating sled types of service station operating mechanisms are shown in U.S. Pat. Nos. 4,853,717 and 5,155,497, both assigned to the present assignee, Hewlett-Packard Company.

Figure 4:
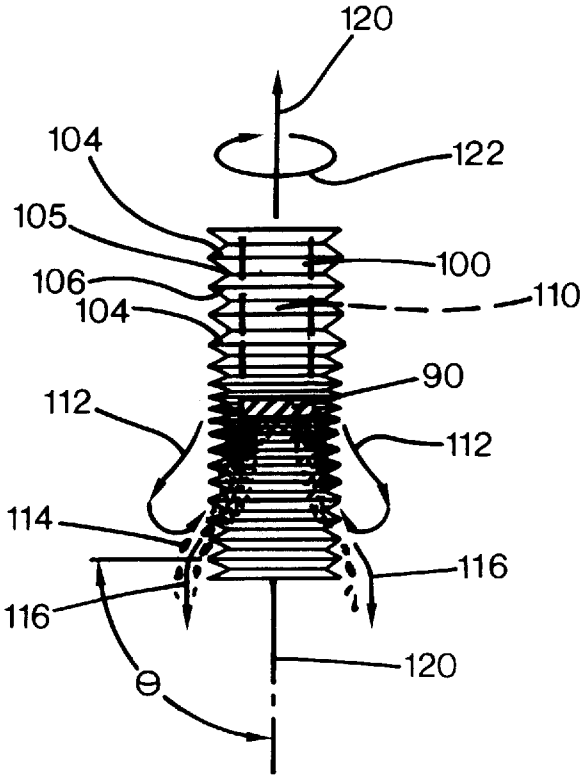
FIG. 4 is a partially schematic, enlarged rear elevational view taken along line 4—4 of FIG. 2, during wiper cleansing, showing the pumping action provided by the wiper to remove ink residue from the cleaner.
Figure 3:
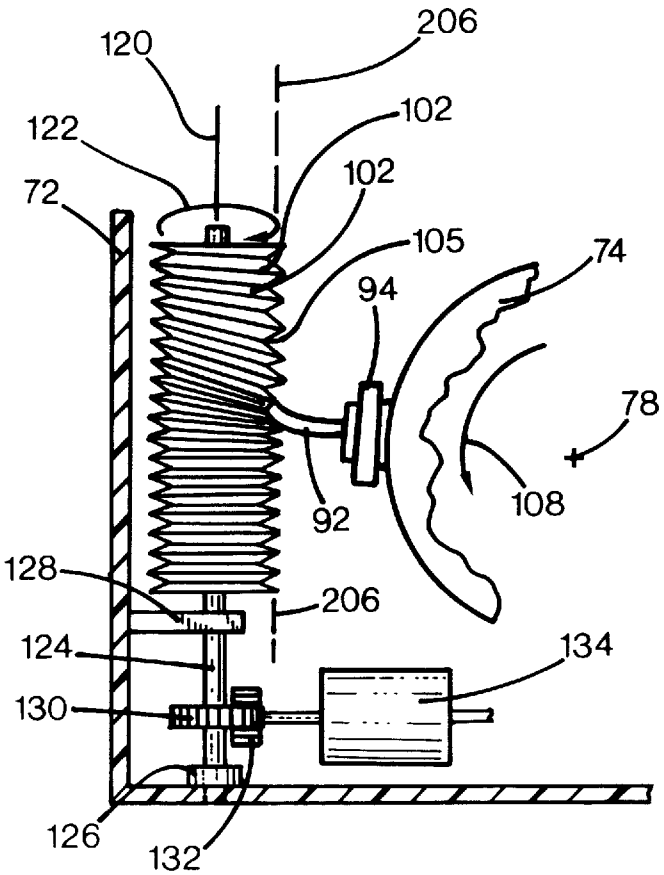
FIG. 3 is a partially schematic, enlarged side elevational view taken along line 3—3 of FIG. 2, showing the cleaner cleansing a printhead wiper.

FIGS. 2–4 show the finned wiping system 88 as including a wiper cleaner system 98 that has a black wiper cleaner 100 and a color wiper cleaner 102, both of which are supported by the service station frame 72 adjacent to the tumbler body 74. The wiper cleaners 100, 102 each comprise a plurality of adjacent, substantially planar flanges or fins 104. When wiping, ink residue is removed from the printheads 64, 66 and transferred to the surfaces of the wiper blades 90, 92. To clean the wipers for the next wiping cycle, the wipers are brought into a sweeping contact with the cleaner fins 104 to remove the ink residue from the surfaces of wiper blades 90, 92 and deposit it on the surfaces of the cleaner fins 104. The fins 104 are spaced apart from one another by an interstice to form an interstitial ink residue capturing region therebetween, such as interstice 105 which is located between fin 104 and an adjacent fin 106 in FIG. 4.

Preferably, the wiper cleaners 100, 102 are constructed of a relatively soft elastomeric material, preferably, an elastomeric material such as santoprene, neoprene, EDPM, or another equivalent elastomer known to those skilled in the art.

Preferably, the durometer (softness/hardness) of the elastomer of cleaners 100, 102 is selected to be lower (softer) than the durometer of the wiper blades 90, 92, which allows the cleaner fins 104 flex more than the wiper blades 90, 92 during cleaning. Selecting the durometer of the wiper fins 104 to be less than that of the wiper blades 90, 92 advantageously avoids unnecessary wear to the wipers during cleaning.

Another advantage is realized by selecting an elastomeric material for the wiper cleaner, rather than a plastic as in the past, because elastomers and plastics have different surface wetting characteristics. Specifically, ink residue has a greater tendency to stick to the elastomeric cleaner than to the earlier plastic wiper scraper, so the wiper blades 90, 92 are cleaned more efficiently with the cleaners 100, 102. Moreover, the softer cleaner fins 104 provide a plurality of cleaning surfaces for the wiper blades 90, 92 to interact with during cleaning, rather than only one or two surfaces provided by the earlier plastic scrapers.

As shown in FIGS. 3 and 4, the tumbler 74 is rotating around axis 78 in a direction indicated by the curved arrow 108, so the wipers 90, 92 is moving downwardly with respect to the cleaner 100, 102. During the cleaning process, the fins 104 are compressed through contact with the wiper blades 90, 92 along a cleaning region 110 (indicated by the pair of heavy vertical dashed lines in FIG. 4) across which the wiper blades traverse from one fin to the next adjacent fin. This compression of the fins decreases the interstice 105 between adjacent fins, in some areas to the point where two adjacent fins touch one another and momentarily, the interstice 105 disappears completely.

As best shown in FIG. 4, this compression of adjacent fins and resulting decrease in volume of the interstitial region 105 provides a pumping action during wiper cleaning. This pumping action forces ink residue lodged in the interstices 105 to be pumped out from the cleaning region 110 and around toward the sides adjacent to the cleaning region 110, as indicated by the curved arrows 112. After being pushed out of the cleaning region 110, the ink residue begins to dry and form either flakes or gelled balls 114 of ink residue, depending upon the kind of ink formulation being used. The dried residue of dye-based inks, such as those dispensed by the color cartridge 62 typically flake, whereas a pigment-based ink, such as that dispensed by cartridge 60 tends to form the ink balls 114. The texture of these ink balls 114 resembles the sticky texture of the adhesive rubber cement when drying. Pumping action provided by subsequent wiper strokes flexes the fins 104. This fin flexing action detaches the ink residue flakes from the fin surfaces and the flakes either fall or flip off the fins. The flexing fins also dislodge the sticky ink balls 114, which then fall as indicated by arrows 116 for collection near the bottom surface of the service station frame 72. Thus, the relative movement and interaction of the wiper blades 90, 92 with respect to the cleaners 100, 102 provides both a pumping action and a flexing action, that together give a self-cleaning property to the finned wiping system 88.

In addition to this pumping action, ink is also removed from the cleaning region 110 through capillary action, as the liquid component of the ink wicks away along the channel defining the interstitial regions 105. Preferably, the interstices 105 have one or more sharp corners, such as the single groove between adjacent fins 104 and 106 in FIG. 4. Capillary action is enhanced as the liquid ink residue is drawn into these sharp corners or narrow grooves and escapes from the cleaning region 110. In the illustrated embodiment, the cleaner fins 104 are all molded as a single unitary part, although it is apparent that each fin could be separately molded and then mounted on a common shaft or other base.

In other alternative embodiments, it may be preferable to construct a cleaner having fins of varying shapes, spacings or geometries, rather than the uniform fins 104. In the illustrated embodiment, the black and color cleaners 100, 102 are constructed the same, although in other embodiments, it may be more suitable to use different fin geometries or different fin spacings for them. In some implementations it may be preferable to construct one cleaner with group of fins all having a rectangular shape and extending upwardly from a flat planar base, for example, when wiping the printheads with a translational motion, rather than the illustrated rotary wiping motion.

Nonetheless, presently the illustrated cylindrical arrangement of disk-shaped fins 104 is preferred. With the cylindrical disk arrangement of fins 104, the cleaners 100, 102 may be rotated about their longitudinal axes, such as axis 120 for cleaner 100, as indicated by curved arrow 122. In this manner, at selected intervals a fresh surface may be provided to serve as the cleaning region 110, for instance, after a long period of printer inactivity. It may also be advantageous to refresh the cleaning surface 110 during a lengthy print job, such as during a media pick routine between the end of one sheet and the beginning of the next sheet to be printed.

One preferred method for rotating the cleaners 100, 102 is shown in FIG. 3, where the wiper cleaner 102 is mounted to a shaft 124, which extends down to a pivotal mounting portion, such as bearing 126 in the service station frame 72. One or more stand-off supports or guide members 128 extending from the frame 72 may be used to provide lateral stability to the wiper cleaner. The illustrated cleaner shaft 124 has a drive gear 130 that is driven by a pinion gear 132, which is selectively rotated by a motor 134. It is apparent that other drive mechanisms may be substituted for the gear/motor assembly 130–134 to rotate the cleaners. For example, a worm gear assembly, a linkage arm, or a ratchet assembly (not shown) may be coupled to the tumbler body 74 and cleaners so the cleaners 100, 102 rotate in response to rotation of the tumbler 74.

In the illustrated embodiment, the fins 104 are disk shaped in nature, and aligned at an angle θ (see FIG. 4) with respect to the longitudinal axis 120. The illustrated fin alignment angle θ is 90° so the fins 104 are each substantially perpendicular to the longitudinal axis 120. However, it is apparent that the fins 104 may be tilted at an angle θ other than 90°. Indeed, such tilting of the fins may promote autorotation of the cleaners 100, 102 to refresh the cleaning region 110 during a cleaning stroke, assuming the cleaners are pivotally mounted within the service station frame 72. In this embodiment, there would be no need for the gear/motor assembly 130–134, or a mechanical linkage mechanism between the tumbler 74 and the cleaners for refreshening. In another variation, the cleaners 100, 102 may be tilted with respect to the vertical plane through which the wiper blades, so the longitudinal axes 120 would be tilted to either the right or the left as viewed in FIGS. 2 and 4. This tilting may also promote autorotation of the cleaners 100, 102 when encountered by blades 90, 92.

Multi-Finned Wiping System: Finned Wiper Embodiment

Figure 5:
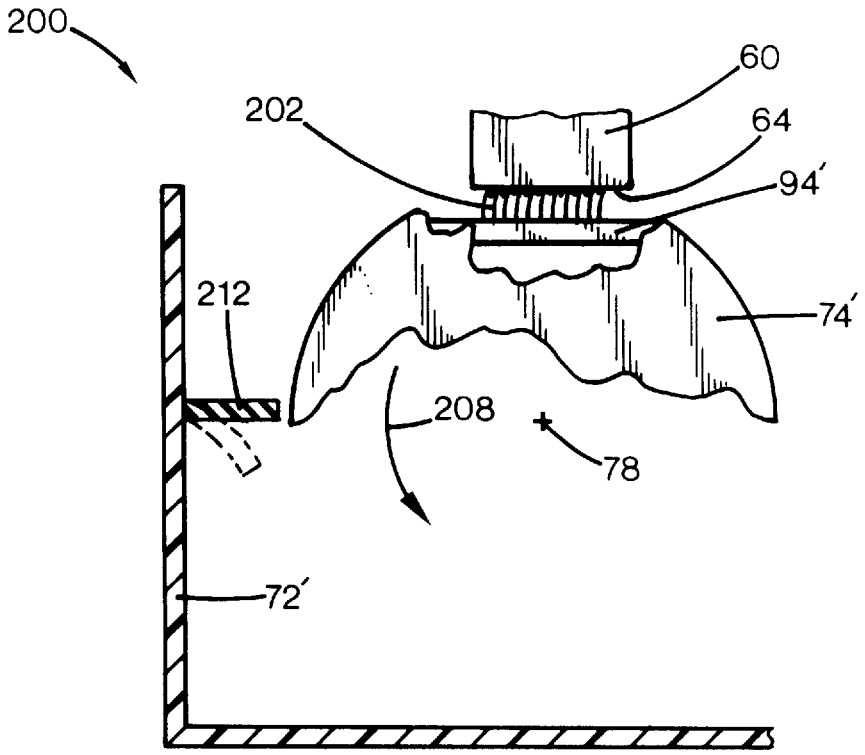
FIG. 5 is a partially schematic, side elevational view of one form of an alternate embodiment of a finned wiping system of the present invention, here comprising a multi-finned wiper.
Figure 6:
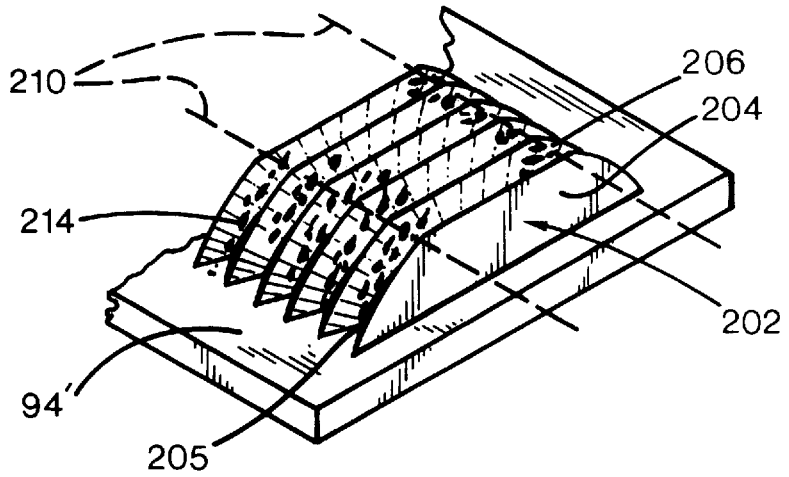
FIG. 6 is an enlarged perspective view of a portion of the multi-finned wiper of FIG. 5.

FIGS. 5 and 6 illustrate an alternate multi-finned wiping system 200, constructed in accordance with the present invention, which expands upon the finned concept of the cleaners 100, 102 by locating a finned wiping member 202 on an alternate wiper platform 94'. The platform 94' is supported by an alternate tumbler 74' mounted in an alternate service station frame 72', each of which may have the same construction described above for items 94, 74, and 72, respectively. The finned wiper 202 may be constructed as described above for cleaners 100, 102, although rather than using disk-shaped fins 104, a group of modified truncated disk shaped fins 204 is used. Adjacent fins are separated by an interstice, such as interstice 205 which is located between fin 104 and an adjacent fin 206 in FIG. 6. Upon rotating the tumbler 74' in the direction of arrow 208, the finned wiper 202 is drawn across the printhead, here printhead 64, to remove accumulated ink residue from the nozzle plate, as shown in FIG. 5.

The modified disk shape of fins 204 has a substantially flat top section defining a cleaning region 210 (shown in dashed lines in FIG. 6) which contacts the printhead during a wiping stroke. Preferably, the fins 204 arc downwardly at each side of the cleaning region 210, which enhances the structural integrity of the fins. By varying the size and thickness of the fins, their durometer, their spacing (size of the interstices 205), as well as the slope of the side arcs, the relative wiping force can be varied to accommodate different types of printheads and inks. For instance, to adequately wipe the pigment-based ink residue from the black printhead 64, it may be preferable to use a stiffer fin that is more resistant to bending, than that required to wipe the dye-based color ink residue from the color printhead 66.

Another advantage to the modified shape of fins 204, and perhaps a prime motivation for this construction, is the provision of an arced wicking path along the bottom of the interstitial region 205. This arced wicking path draws the liquid portions of the ink residue away from the cleaning region 210 by gravity and through capillary action. It is apparent though, that other fin shapes may also be substituted for fins 204, such as a rectangular or trapezoidal shape.

After wiping the printhead 64, the tumbler body 74' is rotated in the direction indicated by arrow 208 to be cleaned by a wiper cleaner 212 of an elastomeric material, such as that described above for the cleaners 100, 102. Here, the wiper cleaner 212 is supported by the upright wall of the service station frame 72', and shown in dashed lines in a flexed or bent position which it obtains during cleaning of the finned wiper 202. Alternatively, rather than mounting the cleaner 212 to the side wall, it may be mounted to the lower or bottom wall of the service station frame 72'. While an elastomeric cleaner blade 212 is illustrated, in some embodiments it may be preferable to provide a rigid wiper blade, perhaps integrally molded with the plastic structure of the service station frame 72'.

Preferably, the cleaner blade 212 is of an elastomeric material which avoids unnecessary wear of the wiper fins 204. The selection of the durometer of the cleaner 212 relative to that of the wiper fins 204, may be best based upon the relative dimensions of the fins, that is their thickness and bending radius, as well as the type of ink which is being wiped, be it dye-based or pigment-based. However, to achieve the pumping action of removing ink residue 214 from the interstices 205 between the fins (accomplished in the same manner as described above for removing residue 114 from interstices 105), it is believed to be preferable to have the cleaner blade 212 be constructed for less flexing than that experienced by the fins 204 during cleaning. The cleaner blade 212 may be stiffened by using a different material than that used for the wiper 202, by using a greater (harder) durometer material, or by using a thicker configuration for less flexing of the cleaner blade 212.

Alternate arrangements for moving the wipers 90, 92 or 202 against the cleaners 100, 102 or 212, respectively, are also possible. For example, rather than the rotary tumblers 74, 74' supporting wipers 90, 92, 202, the wipers may be moved translationally in a linear fashion with respect to the printheads 64, 66. Several examples of such translating service stations are or have been used in commercially available inkjet printing mechanisms. For instance, suitable translating or floating sled types of service station operating mechanisms are shown in U.S. Pat. Nos. 4,853,717 and 5,155,497, both assigned to the present assignee, the Hewlett-Packard Company.

A method of wiping accumulated ink residue from inkjet printheads 64, 66 is provided, including the steps of ejecting ink though inkjet printheads 64, 66 and accumulating ink residue thereon, and wiping the accumulated ink residue from the printhead using a wiper, either of a blade configuration 90, 92 or a finned configuration 202. Following the wiping step, the wiper 90, 92, 202 is then moved from the printhead wiping position to a cleaning position, preferably through relative motion of the platform 94, 94' upon which the wiper is mounted. In some embodiments, it may be more preferable to move the wiper cleaner 100, 102, 205 into a position to engage the wipers 90, 92, 202. In illustrated embodiment, the wipers 90, 92, 202 are moved to contact and engage the cleaners 100, 102, 205, whereby through relative compression of the finned component 100, 102, 202 cleaning of the blades 90, 92, 202 is achieved.

During this process, the ink residue is captured in the interstice 105, 205. Compression of adjacent fins 104, 106 and 204, 206 provides a pumping action, whereby ink residue is removed from the cleaning regions 110, 210 of the finned components 100, 102, 202. Additionally, in a wicking step, capillary action provided by the interstices 105, 205 draws or pulls the liquid components of the ink residue away from the cleaning regions 110, 210. Flexing of the fins 104, 204 during this cleaning process also discharges previously wiped ink from the surfaces of the fins, such as ink balls and flakes 114 shown falling from the fins in FIG. 4. Finally, in a refreshing step, the wiper cleaners 100, 102 may be rotated, for instance, by using the gear and motor assembly 130–134, or through a bar linkage or other mechanical engagement with the tumbler 74.

Conclusion

A variety of advantages are realized using the finned wiper systems 88, 200 described above. For example, the illustrated system 88 reduces ink build-up not only on the wipers 90, 92, but also on the cleaners 100, 102 through the pumping motion indicated by arrows 116 in FIG. 4. Thus, even without the rotation feature (arrow 122 in FIG. 3), the finned cleaners 100, 102 are self-cleaning in that they discharge previously wiped ink residue from the fin surfaces at the same time they clean the wipers 90, 92. Furthermore, by selecting the material of cleaners 100, 102 to be softer than that of blades 90 and 92, wiper wear from cleaning the wipers is reduced or eliminated. Another advantage of the finned cleaners 100, 102 is the elimination of flicking of ink residue to undesirable locations within the interior of the printer. This is accomplished because the multiple cleaning surfaces provided by fins 104 removes of the ink residue from the wiper blade surfaces before the wiper leaves the cleaner at the end of the cleaning stroke.

I claim:

1. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper is of a resilient material comprising plural fins arranged to define an interstice between adjacent fins to capture the ink residue in the interstice, with the plural fins defining a cleaning region across which the printhead traverses from one fin to the next adjacent fin through relative motion of the printhead and wiper and a cleaner supported by the service station to selectively contact and clean the wiper, wherein the cleaner comprises a blade of a resilient material selected to press adjacent fins together when contacting the wiper to pump the ink residue from the interstice.

2. A finned wiping system according to claim 1 wherein:

the ink residue has a liquid component; and adjacent fins are located so the interstice forms a passageway that drains the liquid component of the ink residue away from the cleaning region through capillary action.

3. A finned wiping system according to claim 1 wherein:

the wiper comprises a blade of a resilient material; and the cleaner comprises the plural fins, with the plural fins defining a cleaning region across which the wiper blade moves from one fin to the next adjacent fin to clean the wiper.

4. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper, wherein adjacent cleaner fins are located to be pressed together when the wiper blade moves across the cleaning region to pump the ink residue from the interstice.

5. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper, wherein the ink residue has a liquid component, a portion of which dries in an ink residue film on a surface of the cleaner fins; and wherein the plural cleaner fins are configured to be flexed when the wiper blade moves across the cleaning region to flake off the ink residue film from the surface of the cleaner fins.

6. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein either the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper;

wherein the ink residue has a liquid component; and wherein adjacent fins are located so the interstice forms a passageway that drains the liquid component of the ink residue away from the cleaning region through capillary action.

7. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper, wherein the cleaner is movably supported by the service station for movement between a first position and a second position, and the plural fins of the cleaner each have a periphery with a first section and a second section, with the first periphery section of the fins comprising the cleaning region by facing the wiper blade when the cleaner is in the first position, and the second periphery section of the fins comprising the cleaning region by facing the wiper blade when the cleaner is in the second position.

8. A finned wiping system according to claim 7, wherein:

the plural fins of the cleaner are disk-shaped with a circular periphery so the cleaner occupies a cylindrical region having a longitudinal axis; and the cleaner is movably supported by the service station for rotational movement around the longitudinal axis between the first position and the second position.

9. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper, wherein the cleaner has a longitudinal axis, and wherein the plural fins of the cleaner are substantially mutually parallel, with each fin aligned at the same angle with respect to the longitudinal axis.

10. A finned wiping system according to claim 9 wherein the plural fins of the cleaner are aligned with respect to the longitudinal axis at said same angle which comprises a substantially right angle.

11. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material, wherein the resilient material of the wiper blade is of a first hardness; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper, wherein the resilient material of the cleaner fins is of a second hardness that is softer than the first hardness to avoid wiper blade wear from cleaning the wiper.

12. A finned wiping system for wiping an inkjet printhead that accumulates ink residue when used in an inkjet printing mechanism having a chassis, comprising:

a service station supported by the printing mechanism chassis;

a wiper supported by the service station to selectively contact and wipe the printhead to remove ink residue therefrom, wherein the wiper comprises a blade of a resilient material; and a cleaner supported by the service station to selectively contact and clean the wiper, wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper;

wherein the service station includes a frame supported by the printing mechanism chassis;

wherein the service station further includes a tumbler pivotally mounted to the frame;

wherein the cleaner is supported by the frame; and wherein the wiper is supported by the tumbler for pivotal motion between a printhead wiping position where the wiper selectively contacts and wipes the printhead, and a cleaning position, where the wiper is selectively contacts and is cleaned by the cleaner.

13. A method of wiping accumulated ink residue from an inkjet printhead in an inkjet printing mechanism, comprising the steps of:

ejecting ink though the inkjet printhead and accumulating ink residue thereon;

wiping the accumulated ink residue from the printhead using a wiper;

after the wiping step, cleaning the wiper with a cleaner through relative motion of the wiper and cleaner one of which comprises plural fins of a resilient material arranged to define an interstice between adjacent fins;

capturing the ink residue in the interstice;

performing a subsequent cleaning step; and pumping the ink residue from the interstice by pressing the adjacent fins together during the subsequent cleaning step.

14. A method according to claim 13, wherein:

the accumulating step comprises accumulating ink residue having a liquid component;

the capturing step comprises capturing the liquid component of the ink residue in the interstice; and the method further includes the step of removing the liquid component of the ink residue from the interstice through capillary action.

15. A method according to claim 13, wherein the wiping step comprises using a wiper comprising the plural fins, with the plural fins defining a cleaning region across which the printhead traverses from one fin to the next adjacent fin through relative motion of the printhead and wiper.

16. A method according to claim 13, wherein:

the wiping step comprises using a wiper comprising a blade of a resilient material; and the cleaner comprises the plural fins, with the plural fins defining a cleaning region across which the wiper blade moves from one fin to the next adjacent fin during the cleaning step.

17. A method of wiping accumulated ink residue from an inkjet printhead in an inkjet printing mechanism, comprising the steps of:

ejecting ink though the inkjet printhead and accumulating ink residue thereon;

wiping the accumulated ink residue from the printhead using a wiper comprising a blade of a resilient material;

after the wiping step, cleaning the wiper with a cleaner through relative motion of the wiper and cleaner, wherein the cleaner comprises plural fins of a resilient material arranged to define an interstice between adjacent fins, with the plural fins defining a cleaning region across which the wiper blade moves from one fin to the next adjacent fin during the cleaning step; and capturing the ink residue in the interstice;

wherein the plural fins of the cleaner each have a periphery with a first section and a second section, with the first section comprising the cleaning region when facing the wiper blade when the cleaner is in a first position, and the second section comprising the cleaning region when facing the wiper blade when the cleaner is in a second position; and refreshing the cleaning region by moving the cleaner from the first position to the second position.

18. A method according to claim 17, wherein:

the plural fins of the cleaner are disk-shaped with a circular periphery so the cleaner occupies a cylindrical region having a longitudinal axis; and the refreshing step comprises rotating the cleaner around the longitudinal axis.

19. A method of wiping accumulated ink residue from an inkjet printhead in an inkjet printing mechanism, comprising the steps of:

ejecting ink though the inkjet printhead and accumulating ink residue thereon;

wiping the accumulated ink residue from the printhead using a wiper;

after the wiping step, cleaning the wiper with a cleaner through relative motion of the wiper and cleaner one of which comprises plural fins of a resilient material arranged to define an interstice between adjacent fins; and capturing the ink residue in the interstice;

wherein the accumulating step comprises accumulating ink residue having a liquid component;

wherein the cleaning step comprises cleaning the wiper with a cleaner comprising the plural fins by moving the wiper from one fin to the next adjacent fin;

wherein the capturing step comprises capturing the ink residue, including the liquid component thereof in the interstice of the cleaner during the cleaning step; and pumping the captured ink residue from the cleaner interstice by pressing the adjacent fins together with the wiper when moving the wiper from one fin to the next adjacent fin.

20. A method according to claim 13, wherein:

the inkjet printing mechanism has a chassis and the cleaner is supported by the chassis;

the wiper is pivotally mounted to the printing mechanism chassis for rotational movement;

the wiping step comprises rotating the wiper to contact and wipe across the printhead; and the cleaning step comprises rotating the wiper move across the cleaner.

21. An inkjet printing mechanism for printing an image, comprising:

a chassis;

an inkjet printhead that accumulates ink residue while printing the image;

a service station supported by the chassis;

a wiper supported by the service station to selectively contact and wipe the printhead to remove ink residue therefrom; and a cleaner supported by the service station to selectively contact and clean the wiper;

wherein the wiper is of a resilient material comprising plural fins arranged to define an interstice between adjacent fins to capture the ink residue in the interstice, with the plural fins defining a cleaning region across which the printhead traverses from one fin to the next adjacent fin through relative motion of the printhead and wiper; and wherein the cleaner comprises a blade of a resilient material selected to press adjacent fins together when contacting the wiper to pump the ink residue from the interstice.

22. An inkjet printing mechanism according to claim 21 wherein:

the ink residue has a liquid component; and adjacent fins are located so the interstice forms a passageway that drains the liquid component of the ink residue away from the cleaning region through capillary action.

23. An inkjet printing mechanism for printing an image, comprising:

a chassis;

an inkjet printhead that accumulates ink residue while printing the image;

a service station supported by the chassis;

a wiper supported by the service station to selectively contact and wipe the printhead to remove ink residue therefrom, wherein the wiper comprises a blade of a resilient material; and a cleaner supported by the service station to selectively contact and clean the wiper;

wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper;

wherein adjacent cleaner fins are located to be pressed together when the wiper blade moves across the cleaning region to pump the ink residue from the interstice.

24. An inkjet printing mechanism for printing an image, comprising:

a chassis;

an inkjet printhead that accumulates ink residue while printing the image;

a service station supported by the chassis;

a wiper supported by the service station to selectively contact and wipe the printhead to remove ink residue therefrom, wherein the wiper comprises a blade of a resilient material; and a cleaner supported by the service station to selectively contact and clean the wiper;

wherein the cleaner is of a resilient material comprising plural fins arranged to define an interstice between adjacent fins to capture the ink residue in the interstice, with the plural fins defining a cleaning region across which the wiper blade moves from one fin to the next adjacent fin to clean the wiper;

wherein the cleaner has a longitudinal axis;

wherein the cleaner is pivotally supported by the service station for rotation around the longitudinal axis between a first position and a second position; and wherein the plural fins of the cleaner are substantially mutually parallel, with each fin aligned at the same angle with respect to the longitudinal axis, and with each fin having a periphery with a first section and a second section, with the first periphery section of the fins comprising the cleaning region by facing the wiper blade when the cleaner is in the first position, and the second periphery section of the fins comprising the cleaning region by facing the wiper blade when the cleaner is in the second position.

25. An inkjet printing mechanism for printing an image, comprising:

a chassis;

an inkjet printhead that accumulates ink residue while printing the image;

a service station supported by the chassis;

a wiper supported by the service station to selectively contact and wipe the printhead to remove ink residue therefrom; and a cleaner supported by the service station to selectively contact and clean the wiper;

wherein either the wiper or the cleaner is of a resilient material comprising plural fins arranged to define an interstice between adjacent fins to capture the ink residue in the interstice;

wherein the service station includes a frame supported by the chassis;

wherein the service station further includes a tumbler pivotally mounted to the frame;

wherein the cleaner is supported by the frame; and wherein the wiper is supported by the tumbler for pivotal motion between a printhead wiping position where the wiper selectively contacts and wipes the printhead, and a cleaning position, where the wiper selectively contacts and is cleaned by the cleaner.

26. A finned wiping system according to claim 1 wherein each of the plural fins are of substantially the same size and shape.

27. An inkjet printing mechanism according to claim 21 wherein each of the plural fins are of substantially the same size and shape.

* * * * *